US005652475A

United States Patent [19]

Lee

[11] Patent Number: 5,652,475

[45] Date of Patent: Jul. 29, 1997

[54] ELECTRON GUN FOR A COLOR PICTURE TUBE HAVING ECCENTRIC PARTITIONS ATTACHED TO THE FIRST AND SECOND FOCUSING ELECTRODES

[75] Inventor: Kyoung Sub Lee, Kyungsangbuk-Do, Rep. of Korea

[73] Assignee: LG Electronics Inc., Seoul, Rep. of Korea

[21] Appl. No.: 529,004

[22] Filed: Sep. 15, 1995

[30] Foreign Application Priority Data

Sep. 16, 1994 [KR] Rep. of Korea ..... P94-23672

[51] Int. Cl.[6] ..... H01J 29/48

[52] U.S. Cl. ..... 313/412; 313/414; 313/427

[58] Field of Search ..... 313/412, 414, 313/452, 460, 428, 432, 439

[56] References Cited

U.S. PATENT DOCUMENTS

| | | | |
|---|---|---|---|
| 4,772,826 | 9/1988 | Bloom et al. | 313/412 |
| 4,772,827 | 9/1988 | Osakabe | 313/414 |
| 5,032,760 | 7/1991 | Kim | 313/414 |
| 5,300,855 | 4/1994 | Kweon | 313/412 |

*Primary Examiner*—Sandra L. O'Shea
*Assistant Examiner*—Vip Patel
*Attorney, Agent, or Firm*—Fish & Richardson P.C.

[57] ABSTRACT

An electron gun for a color picture tube which allows the foci of electron beams to coincide with one another. Making an eccentricity between beam-passing apertures and holes on partitions, the electron gun reinforces an electron lens effect, so that the foci of electron beams can coincide with one another.

4 Claims, 4 Drawing Sheets

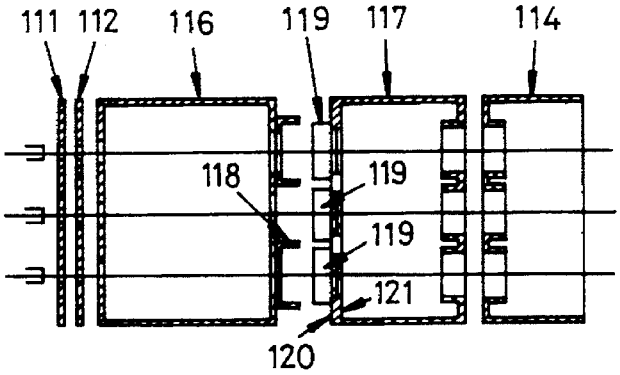
FIG. 6A
(PRIOR ART)
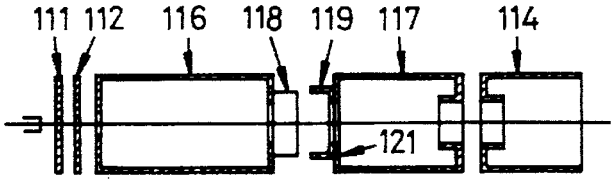
FIG. 6B
(PRIOR ART)
FIG. 6C (PRIOR ART)
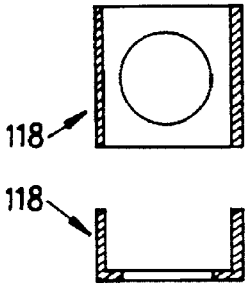
FIG. 6D
(PRIOR ART)
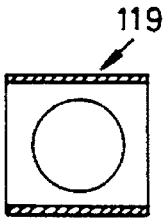
FIG. 6E
(PRIOR ART)
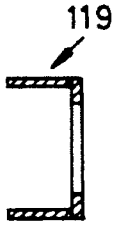
FIG. 6F
(PRIOR ART)
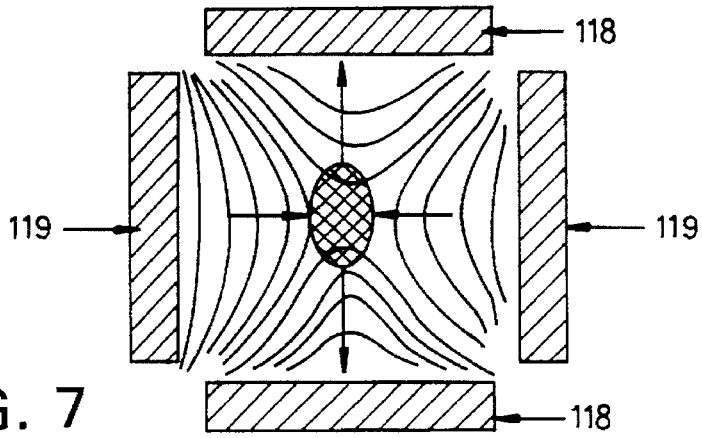
FIG. 7
(PRIOR ART)

ELECTRON GUN FOR A COLOR PICTURE TUBE HAVING ECCENTRIC PARTITIONS ATTACHED TO THE FIRST AND SECOND FOCUSING ELECTRODES

BACKGROUND OF THE INVENTION

1. Field of the Invention

The present invention relates to an electron gun for a color picture tube. Particularly this invention relates to an electron gun for a color picture tube that is capable of reinforcing mechanically an electron lens effect formed by electrodes, so that the discord between beam loci at the peripheral portions of a screen can be prohibited.

2. Description of the Prior Art

A simplified view of a general color picture tube is shown in FIG. 1.

Referring to FIG. 1, a color picture tube 1 is provided with a panel 5 on which fluorescent bodies 8 are coated; a funnel 2; an electron gun 4 for radiating electron beams; a neck 9 in which the electron gun 4 is furnished; a deflection yoke 6 for deflecting the electron beams emanating from the electron gun 4; and a shadow mask 7 for guiding the electron beams to the fluorescent bodies corresponding to each primary additive colors red, green, and blue.

FIG. 2 shows a sectional structure of the electron gun 4. As shown, the electron gun 4 is composed of cathodes 10 for radiating thermions; a first grid electrode 11 and a second grid electrode 12 for forming electron beams by controlling the quantity of the thermions and accelerating the thermions; and a focusing electrode 13 and an acceleration electrode 14 for focusing beam spots on the screen by further focusing the electron beams which passed through the grid electrodes 11 and 12.

Among three electron beams, two outer beams pass through an electron lens formed by both the focusing electrode 13 and the acceleration electrode 14. At the same time, the paths of the two beams are bent towards a central beam by an eccentricity 15 of beam-passing apertures on both the two electrodes 13 and 14. Then, the two outer beams coincide with the central beam, when they arrive at the panel 5.

At this time, the three electron beams, passing through microholes on the shadow mask 7, impinge on the fluorescent bodies. The two outer beams impinge on both red-luminant fluorescent bodies and blue-luminant fluorescent bodies, respectively, while the central beam impinges on green-luminant fluorescent bodies, so that the natural color of red, green, and blue can be realized.

The deflection yoke 6 deflects the electron beams to make the beams impinge on necessary dots on the fluorescent screen.

However, there appears a problem that beam spots focused on the screen does not coincide with one another because the distance between the electron gun and the central portion of the screen differs from that between the electron gun and the peripheral portions of the screen.

To avoid the above problem, typically a self-convergence deflection yoke has been used. As shown in FIGS. 3 and 3A, the self-convergence deflection yoke forms a pincushion magnetic field in a horizontal direction, while forming barrel magnetic field in the direction of a first compensation electrode. This electrode is built in the deflection yoke, perpendicularly to the screen.

However, another problem takes place although the self-convergence deflection yoke can be adopted. When electron beams are, with reference to FIG. 4, deflected or focused, they are normally focused in a horizontal direction, but abnormally over-focused in the direction of the first compensation electrode, or in a vertical direction. That is, a true spot is formed in a horizontal direction, but a halo phenomenon occurs in a vertical direction.

To avoid the above halo, it has been suggested that apertures on the electrodes be made to be eccentric such that astigmatism of the beam spot in the central portion of the screen is positive. The astigmatism means the focusing voltage difference between when the electron beams are accurately focused in a horizontal direction and when they are in a vertical direction.

According to this approach, the beam characteristic on the central portion of the screen becomes a little worse, but the halo at the periphery of the screen can be avoided. That is it restrains a halo phenomenon at the periphery of the screen by trading off improving resolution on the central portion of the screen. But this approach does not fit in with a color picture tube requiring high resolution, either. To avoid those problems, the following method has been developed.

FIG. 5 is a view explaining an optical presentation that the characteristic of an electron lens varies with the variations in voltage on an electrode. The voltage on the electrode varies simultaneously with the deflection yoke, as the electron beams are deflected towards the periphery of the screen. FIGS. 6A and 6B are sectional views showing the electron gun on which such an effect occurs.

The focusing electrode 13 (shown in FIG. 2) is divided into a first focusing electrode 116 and a second focusing electrode 117. To the first focusing electrode 116, a uniform voltage is applied regardless of the deflection yoke. To the second focusing electrode 117, the voltage varying in accordance with the deflection yoke is applied.

Vertical partitions 118, which look like a square bracket as in FIGS. 6C and 6D, are welded on the outer two of the three beam-passing apertures which are located in the front of (in the direction of the screen) the first focusing electrode 116. On three beam-passing apertures located in the rear of (in the direction of the cathode) the second focusing electrode 117, horizontal partitions 119, as shown in FIGS. 6E and 6F, are welded.

The electron beams emanating from the cathodes enter the electron lens which is formed with both the second focusing electrode 117 and the acceleration electrode 114, through the first and second grid electrode 111 and 112. Before entering the electron lens, the electron beams are, as shown in FIG. 7, given a convergent force in a horizontal direction and a divergent force in a vertical direction, which the forces are due to an electric field created between the first and second focusing electrodes 116 and 117. This electric field has been created by the voltage on the second focusing electrode 117. The voltage has increased as the electron beams have been deflected.

Although the beams converge in a horizontal direction, the beam spots are focused accurately in a horizontal direction even at the periphery of the screen because the electron lens becomes weaker owing to the voltage on the second focusing electrode 117. The beam spots vertically diverging by the electron lens are also focused accurately in a vertical direction at the periphery of the screen, by working on with the deflection yoke which deflects an electron beam in a vertical direction.

However, an electron gun for a high-resolution picture tube has a problem that three electron beams cannot easily coincide with one another at the periphery of a screen due to variations in the voltage on a second focusing electrode 117. That is to say, a deflection yoke is usually designed to allow three electron beams to coincide accurately at the central portion of a screen. As the voltage being applied to the second focusing electrode 117 is made to vary in accordance with the deflection of the electron beams, an electron lens becomes weaker and results in discord, though slight, between the beam foci at the periphery of the screen. Resolution of a color picture tube will therefore be deteriorated.

SUMMARY OF THE INVENTION

It is an object of the present invention to prevent resolution of a color picture tube from being deteriorated at the periphery of a screen. The object will be accomplished by allowing each beam foci to coincide throughout the screen. To achieve the above object, there is provided an electron gun for a color picture tube comprising: a first focusing electrode on which three beam-passing apertures are arranged in-line at regular intervals; a first partition, which is formed by bending at a right angle both ends of a base plate on which an opening with the same diameter as the beam-passing aperture of the first focusing electrode is formed, that is attached on outer two of the beam-passing apertures such that each of the bent faces is perpendicular to a beam-passing-apertures-arranged-line, so as to screen the beam-passing apertures at a right angle to the beam-passing-apertures-arranged-line; a second focusing electrode on which three beam-passing apertures with the same diameter as the beam-passing aperture of the first focusing electrode are straight arranged at regular intervals; and a second partition, which is formed by bending at a right angle both ends of a base plate on which an opening with the same diameter as the beam-passing aperture of the second focusing electrode is formed, that is attached on the beam-passing apertures of the second focusing electrode such that each of the bent faces is parallel with a beam-passing-apertures-arranged-line, so as to screen the upper and lower parts of each of the beam-passing apertures, the first and second focusing electrodes being assembled so that the first partitions of the first focus electrode are inserted into a space in which the second partitions of the second focus electrode form, characterized in that:

each of said first partitions is eccentrically attached on said two outermost beam-passing apertures of said first focusing electrode, and outermost two of said second partitions are eccentrically attached on said corresponding two outermost beam-passing apertures of said second focusing electrode.

BRIEF DESCRIPTION OF THE DRAWINGS

The above and other advantages of the present invention will become more apparent after a description of the preferred embodiment of the present invention with reference to the accompanying drawings, in which:

FIGS. 6A and 6B are longitudinal side and top sectional views showing an electron gun having vertical partitions and horizontal partitions;

FIGS. 6C and 6D are simplified views showing a vertical partitions;

FIGS. 6E and 6F are simplified views showing a horizontal partitions;

FIG. 7 is a view showing the characteristic change of an electric field and an electron beam by the difference between the voltages applied to vertical and horizontal partitions;

DETAILED DESCRIPTION OF THE PREFERRED EMBODIMENTS

FIGS. 8, 8A, 9 and 9A show a preferred embodiment of an electron gun for a color picture tube according to the present invention.

Figure 8:
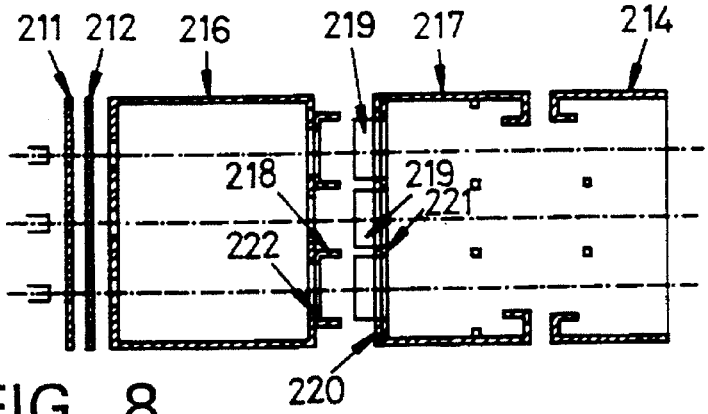
FIGS. 8 and 8A are longitudinal side and top sectional views showing an electron gun for a color picture tube according to the present invention.
Figure 8A:
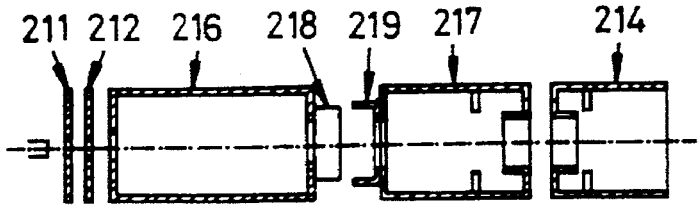
Figure 9:
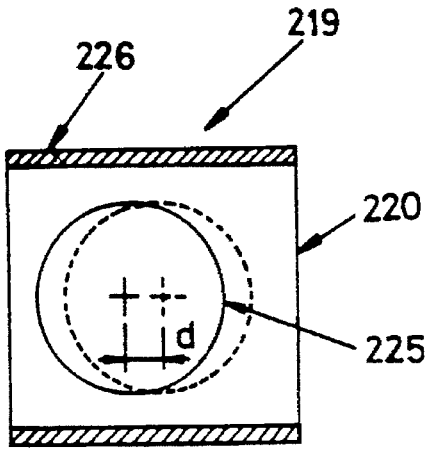
FIGS. 9 and 9A are views showing an eccentricity between one beam-passing aperture on an electrode and an opening on the base of one partition.
Figure 9A:
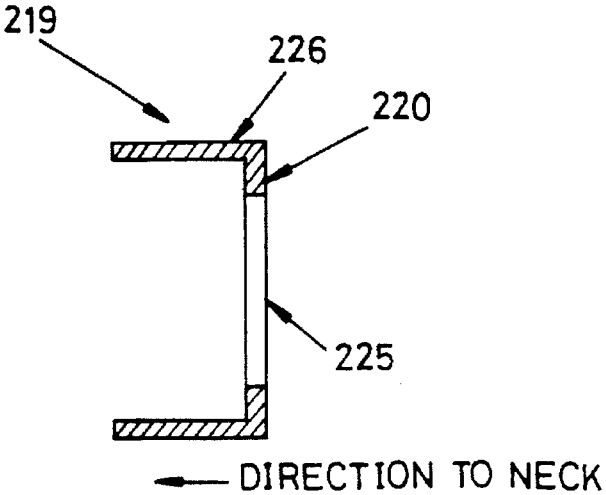

With reference to FIGS. 8 and 8A, the structure of electrodes of the present invention is similar to the electrodes which have been previously discussed in FIGS. 6A–6F. However, it has a structure that the centers of beam-passing apertures are, as shown in FIGS. 9 and 9A, not concentric with the centers of openings of partitions. That is, the vertical and horizontal partitions are assembled such that each of the partitions are eccentric with each of the confronting beam-passing apertures.

Referring to FIGS. 9 and 9A, there are shown two openings. One is located on horizontal partitions 219 (only one of them is depicted) which are welded on two outer-positioned beam-passing apertures on a second focusing electrode 217; the other is the center beam-passing aperture. The former is depicted in a solid line, and the latter in a broken line.

As shown, it is noticeable that the centers of the two openings are eccentric with each other. The beam-passing aperture is shifted inwardly from the opening on the base of the partition. Similarly, two vertical partitions 218 on a first focusing electrode 216 are shifted.

Figure 1:
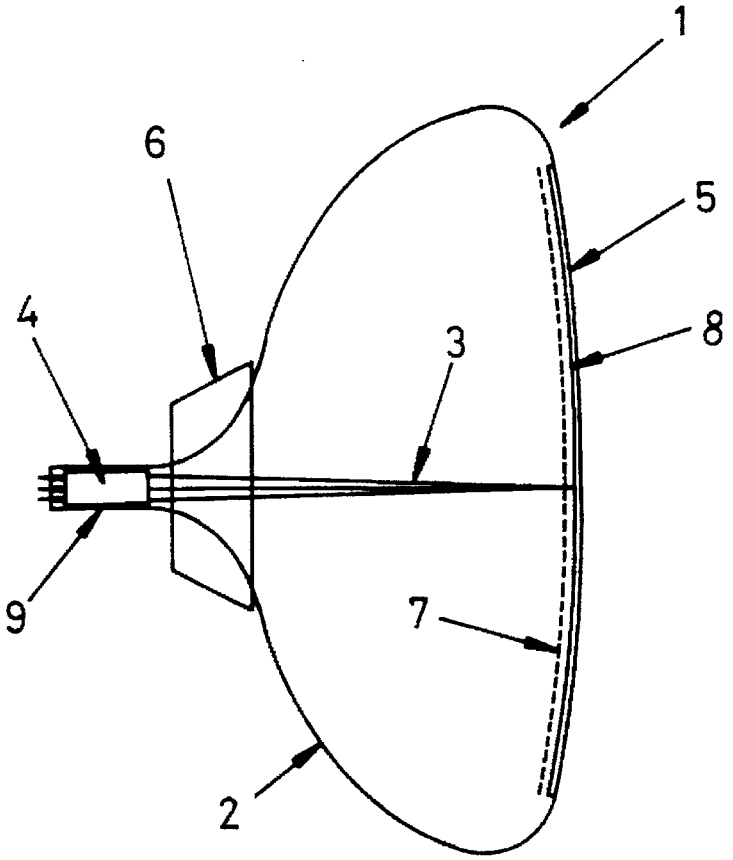
FIG. 1 (PRIOR ART)
FIG. 1 is a view simply showing a structure of a general color picture tube.
Figure 2:
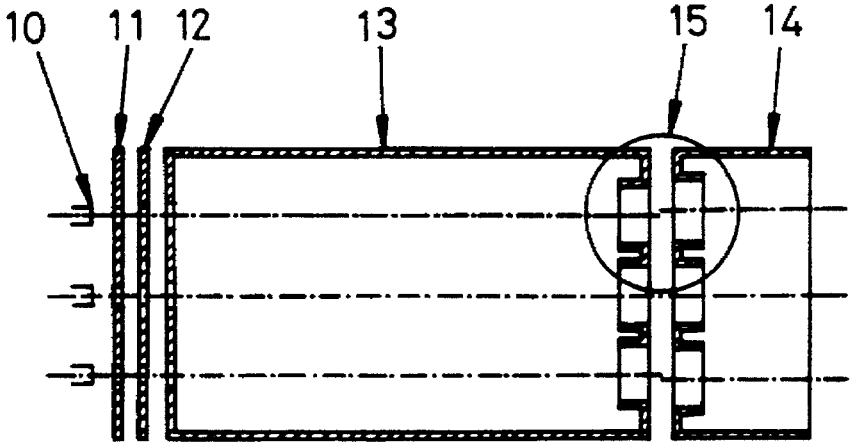
FIG. 2 (PRIOR ART)
FIG. 2 is a longitudinal sectional view showing a general in-line electron gun for a color picture tube.
Figure 3:
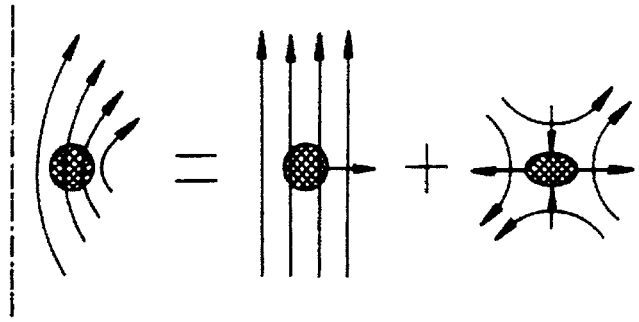
FIG. 3 (PRIOR ART)
FIGS. 3 and 3A are views explaining how beam spots are modified by a magnetic field created by a self-convergence deflection yoke in the horizontal and vertical directions, respectively.
Figure 3A:
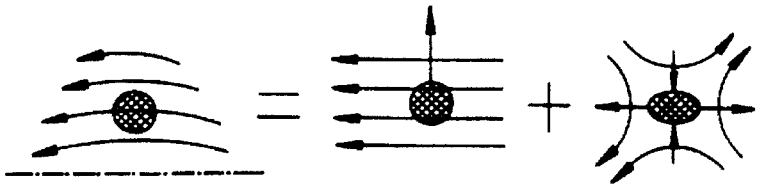
FIG. 3A (PRIOR ART)
Figure 4:
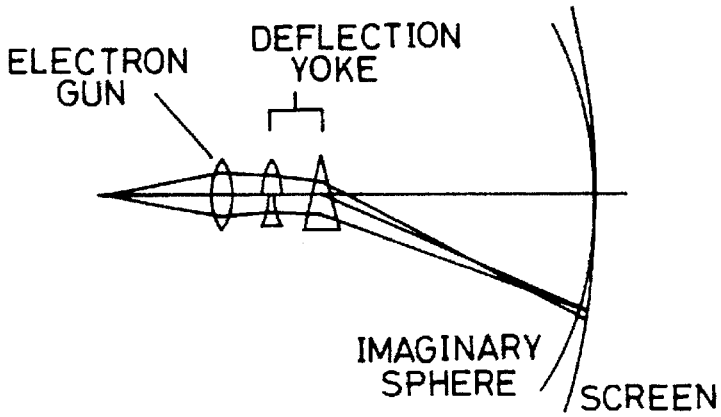
FIG. 4 (PRIOR ART)
FIG. 4 is an optical representation explaining a beam characteristic according to a self-convergence deflection yoke at the periphery of a screen.
Figure 5:
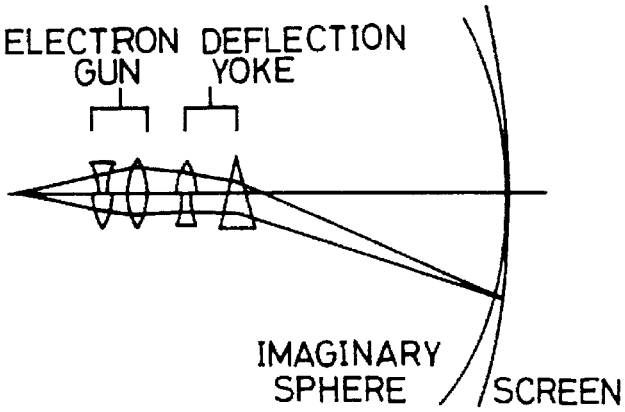
FIG. 5 (PRIOR ART)
FIG. 5 is a view optically explaining a beam characteristic, at the periphery of a screen, according to varying the voltages on both a self-convergence deflection yoke and a second focusing electrode.

In function, as the voltage over the second focusing electrode 217 increases, the paths of two outer electron beams are more deflected towards a central beam. As a result, an electron lens effect formed by both the second focusing electrode 217 and an acceleration electrode 214 is reinforced, so that discord between beam foci on a screen, as shown earlier in FIG. 4, can be made up for.

The following table shows empirical data on the working of the above-structured electron gun.

A numerical analysis by a computer system was used.

| Voltage on second focusing electrode | Amount of eccentricity (d) | | |
|---|---|---|---|
| | 0.1 mm | 0.3 mm | 0.5 mm |
| = Voltage on first focusing electrode(Vf) | 0.03 mm | 0.17 mm | 0.29 mm |
| = Vf + 250 V | 0.07 | 0.12 | — |
| = Vf + 500 V | 0.13 | 0.09 | 0.00 |
| = Vf + 750 V | 0.16 | 0.03 | — |
| = Vf + 1000 V | 0.18 | 0.02 | −0.09 |

The above result shows deviation or discord between three beam foci at the periphery of a screen. Dimensions of each components are as follows:

length of a first focusing electrode (except a vertical partition)=25.13 mm;

length of a vertical partition=2.31 mm;

thickness of the vertical partition=0.4 mm;

diameter of an opening on the base of the vertical partition=4.4 mm;

distance between the center of the opening and the face of the vertical partition=2.7 mm;

distance between both faces of the vertical partition=4.4 mm;

distance between the first focusing electrode (except the vertical partition) and a second focusing electrode (except a horizontal partition)=6.14 mm;

length of the second focusing electrode (except the horizontal partition)=9.67 mm;

length of the horizontal partition 219=3 mm;

thickness of the horizontal partition 219=0.33 mm;

diameter of an opening 225 on the base of the horizontal partition 219=4.4 mm;

distance between the center of the opening 225 and the face of the horizontal partition 226=2.55 mm;

width of the horizontal partition 219=4.4 mm;

distance between the second focusing electrode and an acceleration electrode=1 mm;

length of the acceleration electrode=7 mm;

distance between the respective electron beams=5.5 mm;

voltage over the first focusing electrode=9060 V; and voltage over the acceleration electrode=32000 V.

We could obtain the foregoing result by the way that the voltage over the second focusing electrode was made by adding the voltages of 250, 500, 750, and 1000 V to the voltage over the first focusing electrode 216, neglecting the deflection of the electron beams.

The amount of an eccentricity d was established by 0.1, 0.3, and 0.5 mm, respectively. Since a numerical analysis by a computer simulation was used, there might be some computational error. Nevertheless the tendency for deviation was sufficiently predictable.

Observing as a whole the voltage values over the second focusing electrode in the above table, it is understandable that, when the amount of the eccentricity d ranges from 0.1 through 0.3 mm, deviation between the respective beam foci is minimized.

As for efficacy of the present invention, the present invention reinforces an electron lens effect by mechanical approach, i.e., providing an eccentricity of beam-passing apertures, so that discord between the respective beam foci at the periphery of a screen can be prohibited.

The present invention is not limited to this embodiment, but various variations and modifications may be made without departing from the scope of the present invention.

What is claimed is:

1. An electron gun for a color picture tube comprising a first focusing electrode on which three beam-passing apertures are arranged in-line at regular intervals; a first partition, which is formed by bending at a right angle its both ends of a base plate on which an opening with the same diameter as the beam-passing aperture of the first focusing electrode is formed, that is attached on outer two of the beam-passing apertures such that each of the bent faces is perpendicular to a beam-passing-apertures-arranged-line, so as to screen the beam-passing apertures at a right angle to the beam-passing-apertures-arranged-line; a second focusing electrode on which three beam-passing apertures with the same diameter as the beam-passing aperture of the first focusing electrode are arranged in-line at regular intervals; and a second partition, which is formed by bending at a right angle both ends of a base plate on which an opening with the same diameter as the beam-passing aperture of the second focusing electrode is formed, that is attached on the beam-passing apertures of the second focusing electrode such that each of the bent faces is parallel with a beam-passing-apertures-arranged-line, so as to screen the upper and lower parts of each of the beam-passing apertures, the first and second focusing electrodes being assembled so that the first partitions of the first focus electrode are inserted into a space in which the second partitions of the second focus electrode form, characterized in that:

each of said first partitions is eccentrically attached on said two outermost beam-passing apertures of said first focusing electrode, and outermost two of said second partitions are eccentrically attached on said corresponding two outermost beam-passing apertures of said second focusing electrode.

2. An electron gun according to claim 1, wherein said opening of each of said first partitions is outwardly eccentric from said corresponding two outermost beam-passing apertures of said first focusing electrode, and said opening of each of said two outermost second partitions is outwardly eccentric from said corresponding two outermost beam-passing apertures of said second focusing electrode.

3. An electron gun according to claim 1, wherein said first and second partitions are in the shape of a "U".

4. An electron gun according to claim 1, wherein said bent faces of said second partition are curled at the same radius of said beam-passing aperture.

* * * * *